United States Patent [19]

Ohsuka et al.

[11] Patent Number: 4,912,737

[45] Date of Patent: Mar. 27, 1990

[54] X-RAY IMAGE OBSERVING DEVICE

[75] Inventors: Shinji Ohsuka; Masaru Sugiyama; Tsuyoshi Hayakawa; Katsuyuki Kinoshita; Akira Ohba, all of Hamamatsu, Japan

[73] Assignee: Hamamatsu Photonics K.K., Hamamatsu, Japan

[21] Appl. No.: 263,254

[22] Filed: Oct. 27, 1988

[30] Foreign Application Priority Data

Oct. 30, 1987 [JP] Japan ..... 62-274863
Jul. 11, 1988 [JP] Japan ..... 63-172248

[51] Int. Cl.[4] ..... G21K 7/00

[52] U.S. Cl. ..... 378/43; 378/62; 378/99; 358/111

[58] Field of Search ..... 378/43, 62, 99; 358/111

[56] References Cited

U.S. PATENT DOCUMENTS 2,679,474 5/1959 Pajes ..... 378/43
3,612,867 10/1971 Robodzei et al. ..... 378/43
3,846,632 11/1974 Robodzei et al. ..... 378/43
4,186,302 1/1980 Wang .
4,204,118 5/1980 Sheldon .
4,346,326 8/1982 Driard et al. .
4,362,933 12/1982 Kroener et al. .

FOREIGN PATENT DOCUMENTS 54-91172 7/1979 Japan .
56-156658 12/1981 Japan .
56-165251 12/1981 Japan .
59-94982 5/1984 Japan .
60-212951 10/1985 Japan .
61-163549 7/1986 Japan .
61-250945 11/1986 Japan .
62-500270 1/1987 Japan .
0920479 4/1982 U.S.S.R. ..... 378/43
1406437 9/1975 United Kingdom .

*Primary Examiner*—Carolyn E. Fields
*Assistant Examiner*—David P. Porta
*Attorney, Agent, or Firm*—Beveridge, DeGrandi & Weilacher

[57] ABSTRACT

The X-ray image microscope according to this invention comprises an X-ray absorption imaging unit having a glazing incidence mirror, and an electron imaging unit having an electron lens connected to the X-ray absorption imaging unit. A thin support film is provided on the boundary between the X-ray absorption imaging unit and the electron imaging unit. On the support film is formed a photocathode screen which emits photoelectrons in response to an incident X-ray. The X-ray absorption image of an X-ray which has penetrated a specimen, e.g. a living cell, is magnified by the X-ray imaging unit, and the electron image corresponding to the X-ray image is magnified by an electron lens. The magnified electron image is converted into a light image by a phosphor screen, and the light image is caught by a TV camera. In this way biological materials can be observed, magnified in their living states.

27 Claims, 9 Drawing Sheets

4

X-RAY IMAGE OBSERVING DEVICE

BACKGROUND OF THE INVENTION

This invention relates to an X-ray image observing device, specifically to a device which comprises a vacuum chamber incorporating an X-ray sensitive photocathode screen for emitting electrons in response to incident X-ray photons.

RELATED BACKGROUND ART

X-rays enable thicker objects (specimens) to be observed whose thickness is greater than about 1000 Angstroms (Å), as compared to objects which may be observed with an electron microscope. Because of their high penetrating ability and short wavelength, X-rays permit wet biological materials, for example, human cells, in an atmosphere or a liquid, to be observed.

In the conventional X-ray image observing device, a magnified X-ray absorption image is projected onto an X-ray film made with silver halides, and, after the X-ray film is developed, its magnified image is observed. In particular, in order to observe the image made by a soft X-ray, it is necessary to install a glazing incidence mirror and an X-ray film in a vacuum chamber. The X-ray film is exposed, fixed in the vacuum chamber and then is taken out of the vacuum chamber to be developed. Such conventional radiographic device has the following disadvantages: firstly, the magnified image of a specimen, e.g. a living cell, cannot be transiently observed on the move in a magnified image; secondly, in order to develop the X-ray film, the vacuum chamber has to be broken or the vacuum in the chamber has to be released; and, thirdly, the reproducibility of the relationship between the amount of X-rays radiated onto the X-ray film and the blackening thereof is poor, i.e. an exact linearity between the amount of X-ray radiation and the blackening of the film is not obtained, with a result that an exact, magnified image cannot be obtained for accurate observation. Furthermore, in the above described conventional X-ray image observing device, the developed X-ray film has to either be further enlarged for observation, or else it has to be observed by means of an optical microscope, and consequently, additional steps are required in order to observe a sufficiently magnified image.

Japanese Patent Publication Kokai No. 59-101134, for example, describes a device for observing an image in which an X-ray absorption image is converted by a scintillator into a photoelectric convertible image, the converted image is further converted into an electron image by a photocathode screen, and the electron image is imaged on a phosphor screen. In this device, the X-ray absorption image is not magnified in a vacuum chamber. Accordingly the device can neither observe X-ray absorption images of fine biological materials nor magnify X-ray absorption images at such high magnifications as to be used as a microscope.

"Photoelectron microscope for X-ray microscopy and microanalysis", (Rev. Sci. Instrum 52(2), Feb., 1981, Ps. 207–212) by F. Ploack shows a method comprising fixing a specimen to an X-ray incident window of a vacuum chamber, converting the X-ray which has penetrated the specimen into electrons by an X-ray cathode screen deposited on the inside surface of the vacuum chamber at the opposing postion to the X-ray incident window, and imaging the electron image on a film. This method requires that the X-ray incident window be larger than a certain thickness for the purpose of preventing the breakage of the window due to the pressure difference between the atmosphere and the interior of the vacuum chamber. Accordingly, the X-ray is absorbed by the window and attenuated. This makes it difficult to obtain clear images. It is also difficult using this method to magnify an image at such high magnification as to be used as a microscope.

SUMMARY OF THE INVENTION

An object of this invention is to provide an X-ray image observing device which makes it possible to use X-rays to observe clear magnified images at high magnifications.

Another object of this invention is to provide an X-ray image observing device which enables a specimen, such as living cells, to be observed transiently on the move in magnified X-ray absorption images, continuously or real time.

The X-ray image observing device according to one embodiment of this invention comprises an X-ray source; a vacuum chamber having an input window which permits an X-ray radiated from the X-ray source to penetrate therethrough a first vacuum compartment provided on the side of the vacuum chamber nearer to the input window, and a second vacuum compartment provided on the side thereof farther from the input window; X-ray imaging means for magnifying and focusing the X-ray incident from the input window, at a set position on the boundary between the first and the second vacuum compartments; a photocathode screen assembly for emitting electrons in response to the incident X-ray, disposed at the X-ray focusing position; and an electron imaging means for focusing the electrons emitted from the photocathode screen into the second vacuum compartment, at a set position in the second vacuum compartment.

The X-ray image observing device, according to another embodiment of this invention, comprises a vacuum chamber having a first vacuum compartment formed in the middle thereof, a second vacuum compartment formed on one side of the first vacuum compartment, and a third vacuum compartment formed on the other side of the first vacuum compartment; an X-ray source for radiating X-ray to the first vacuum compartment disposed in the third vacuum compartment; X-ray imaging means for magnifying and focusing X-rays radiated from the X-ray source on a set position on the boundary between the first and the second vacuum compartments; a photocathode screen assembly for emitting electrons in response to the incident X-ray, disposed at the focusing position of the X-ray; and an electron imaging means for focusing the electrons emitted from the photocathode screen to the second vacuum compartment, at a set position in the second vacuum compartment.

The devices according to these embodiments of the invention preferably have imaging means for making a picture of the electron image produced by the electron imaging means which comprises, e.g., converting means for converting the electron image into an optical image, and optical imaging means for taking a picture of the light image. The imaging means has storing means for storing the data obtained by the optical imaging means for a certain period of time.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 4(*b*) is a perspective view of the photocathode screen assembly shown in FIGS. 1 and 4(*a*);

DESCRIPTION OF THE PREFERRED EMBODIMENT

Figure 1:
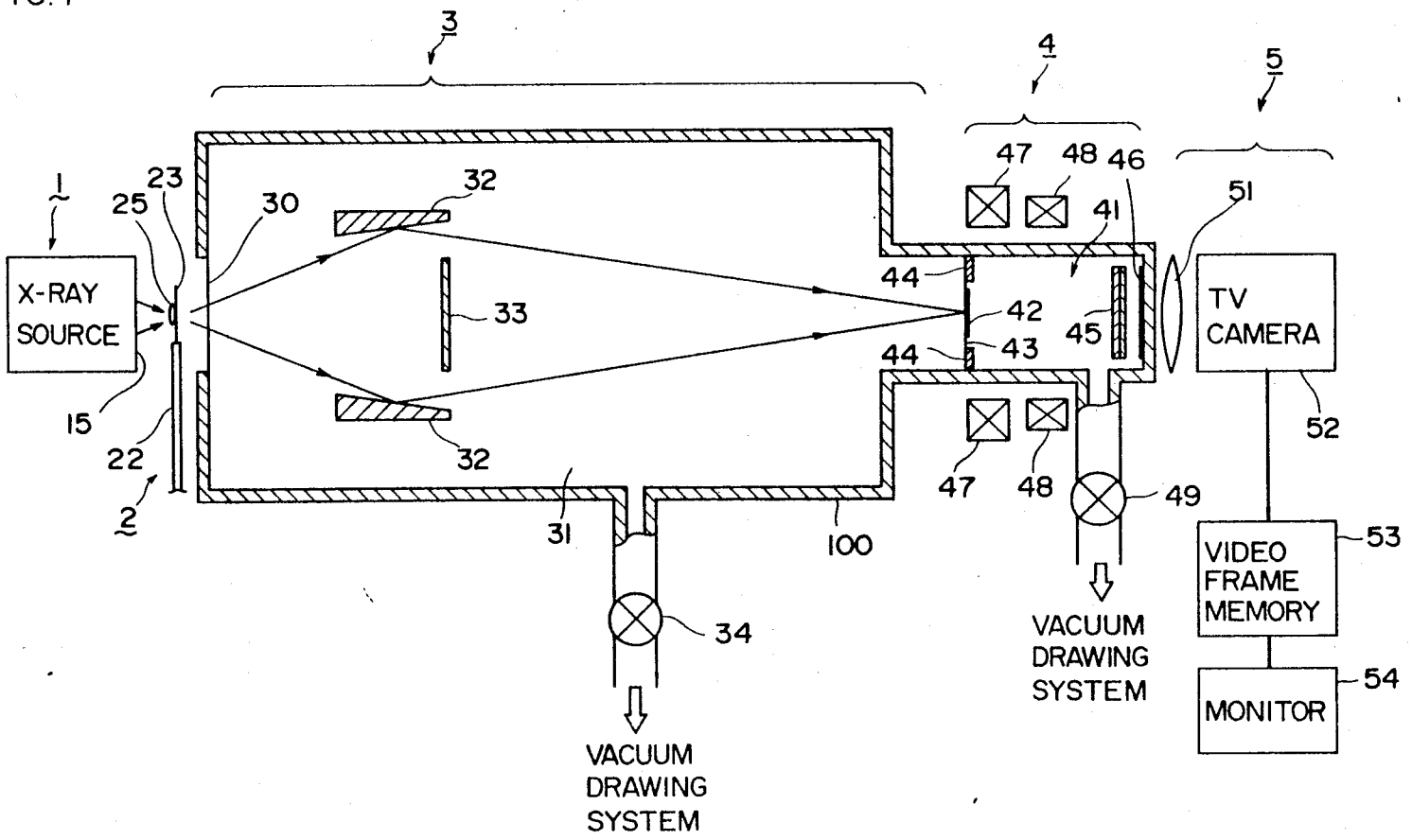
FIG. 1 is a side view of an X-ray microscope incorporating one embodiment of the invention.

In the X-ray image observing device according to one embodiment of this invention, an X-ray imaging unit for making the image of an X-ray which has penetrated a specimen (object to be observed), and an electron imaging unit for focusing the electrons emitted from an X-ray sensitive photocathode screen in response to the incident X-ray onto a microchannel plate (MCP) are disposed in one and the same vacuum chamber or are annexed to the vacuum chamber, and an X-ray source is disposed outside the vacuum chamber. Accordingly the device is characterized in that an X-ray from the X-ray source is incident on the interior of the vacuum chamber through an input window formed in the vacuum chamber. This will be explained in more detail with reference to FIG. 1. An X-ray microscope comprises an X-ray source 1, a specimen mounting unit (object mounting unit) 2 for introducing a specimen 25, e.g. a living cell, in front of the X-ray radiating surface 15 of the X-ray source 1, an X-ray imaging unit 3 disposed in a first vacuum compartment 31 of the vacuum chamber 100 on the side thereof nearer to the specimen mounting unit 2, a second vacuum compartment 41 disposed on the other side of the vacuum chamber 100 and an electron imaging unit 4 disposed in and around the second vacuum compartment 41, and a imaging unit 5 for taking a picture of a magnified image produced by the electron imaging unit 4.

Figure 2A:
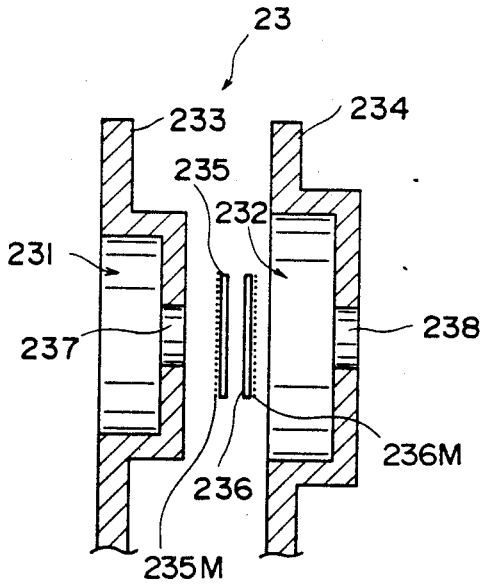
FIGS. 2(*a*), 2(*b*) and 2(*c*) are sectional views of a mounting unit for the specimen to be observed.
Figure 2B:
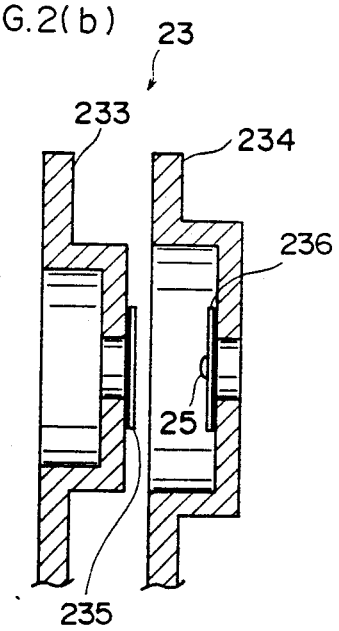
Figure 2C:
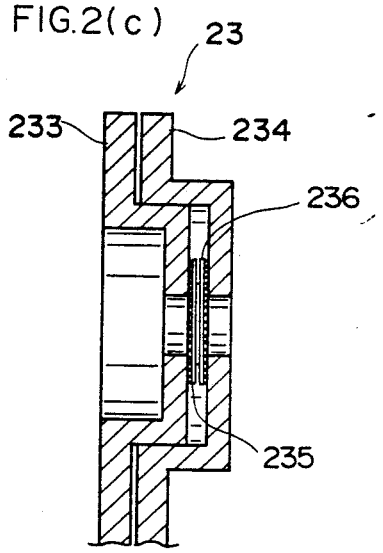

The X-ray tube of the X-ray source 1 generates X-rays of, for example, about 23–44 Å in order that carbon atoms and oxygen atoms are clearly contrasted to each other in the biological material to be observed. A specimen mount 23 is made of a material which the X-ray can penetrate, specifically it is made of a film of an organic material, such as, for example, poly-para-xylylene, etc. The specimen mount 23 has the structure shown in FIGS. 2(*a*)–(*c*), for example. As shown in FIG. 2(*a*), the specimen mount 23 is an assembly of two support plates 233,234 respectively having recesses 231,232, and two organic thin films 235,236 and two metal meshes 235M, 236M. Opening or holes 237,238 are formed in the center of the recesses 231,232 of the support plates 233,234. Each organic thin film 235,236 comprises an X-ray penetrative organic material, such as poly-para-xylylene. The specimen mount 23 is assembled as in FIG. 2(*b*). One of the organic films 235 is adhered to the convex side of the male support plate 233 with one of the metal mesh 235M interposed between the support plate 233 and the thin film 235 so as to close the opening or hole 237. The other organic film 236 is adhered to the concave side of the female support plate 234 with the other metal mesh 236M interposed between the support plate 234 and the thin film 236 so as to close the opening or hole 238. As shown in FIG. 2(*b*), the specimen 25 containing a living cell is attached to the organic film 236, and then the convex portion of the male support plate 233 is inserted into the concave portion 232 of the female support plate 234. Then, as shown in FIG. 2(*c*), the specimen 25 is set. The metal mesh 235M interposed between the support plate 233 and the thin film 235, and the metal mesh 236M interposed between the support plate 234 and the thin film 236 improve the mechanical strength of the films. It is also possible to use the meshes 235M, 236M for focussing. The specimen mount 23 is supported by a manipulater 22, and the specimen mount 23 is moved in the plane perpendicular to optical axis.

As shown in FIG. 1, an input window 30 is formed in the wall of the vacuum chamber 100 opposite to the specimen mount 23. The input window 30 is made of an X-ray penetrative material. An X-ray is incident in the first vacuum compartment 31. The plate is adhered to the opening or hole, which is about 10 mm diameter, formed in the stainless steel vacuum chamber 100. Accordingly the input window 30 includes the X-ray unpenetrative mesh in addition to an X-ray penetrative organic material. However, since the window 30 is placed several millimeters away from the specimen 25, the input window 30 does not hinder imaging the specimen 25. The mesh incorporated in the input window 30 improves the mechanical strength thereof, which prevents the breakage of the input window due to the difference of the atmospheric pressure on each side of the window 30.

An incident X-ray is reflected on a glazing incidence mirror 32, and the reflected X-ray is focussed on the boundary between the first vacuum compartment 31 and the second vacuum compartment 41. Accordingly, a magnified X-ray image of the specimen 25 is produced on a photocathode screen 42 disposed on the boundary between vacuum compartment 31 and 41. A stopper 33 serves to shut off unnecessary X-rays. The first vacuum compartment 31 is connected to a vacuum drawing system, such as a vacuum pump, through a valve 34 so that a degree of vacuum of above about $10^{-5}$–$10^{-6}$ Torr may be obtained.

Figure 3:
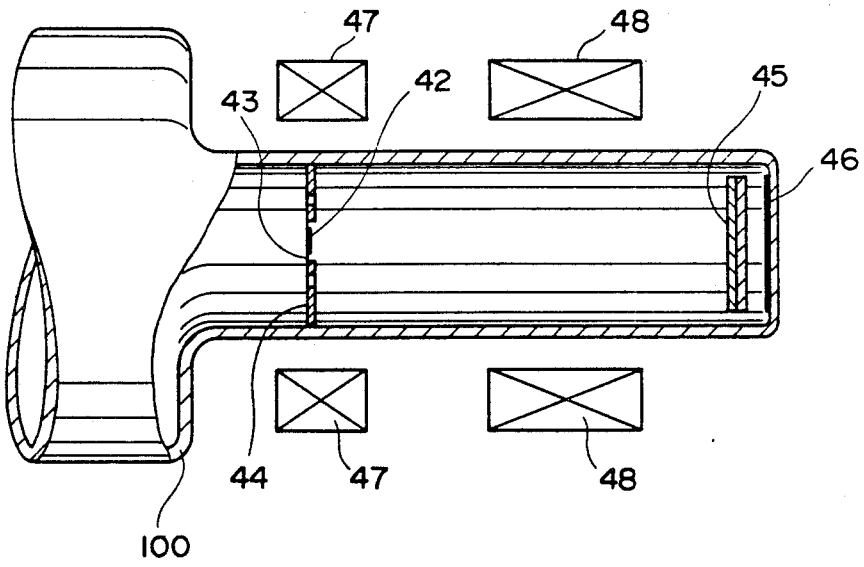
FIG. 3 is an enlarged side view of the electron imaging unit shown in FIG. 1.
Figure 4A:
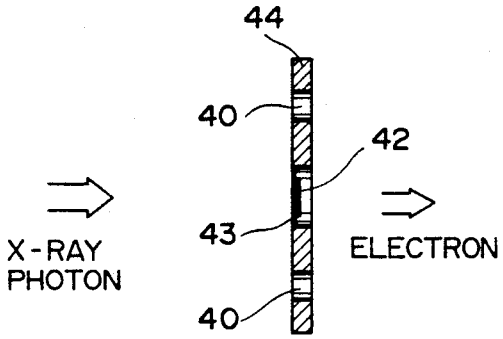
FIG. 4(*a*) is a sectional view of the photocathode screen assembly shown in FIG. 1.
Figure 4B:
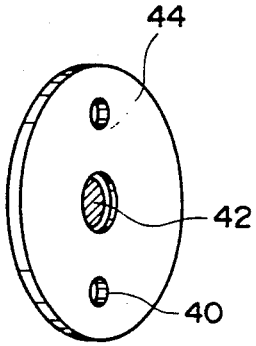
Figure 5A:
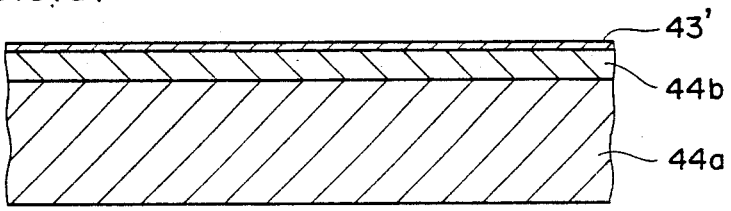
FIGS. 5(*a*)–(*d*) are sectional views, illustrating the process of forming the photocathode screen and the support film for the embodiments of this invention.
Figure 5B:
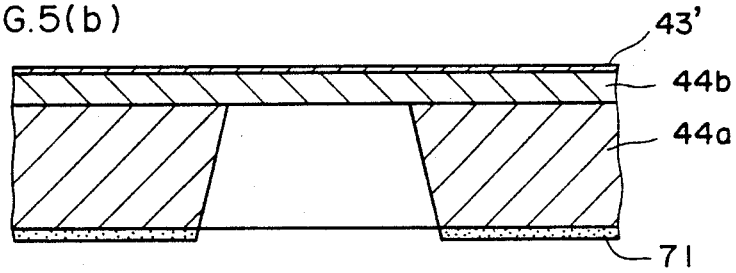
Figure 5C:
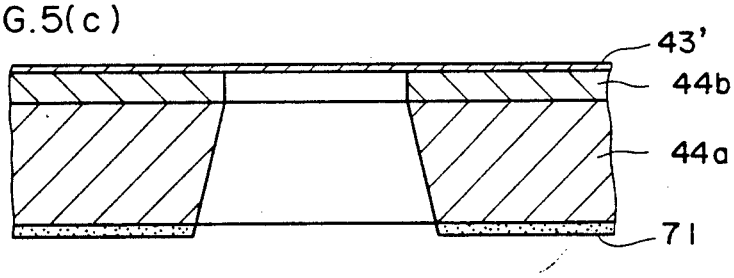
Figure 5D:
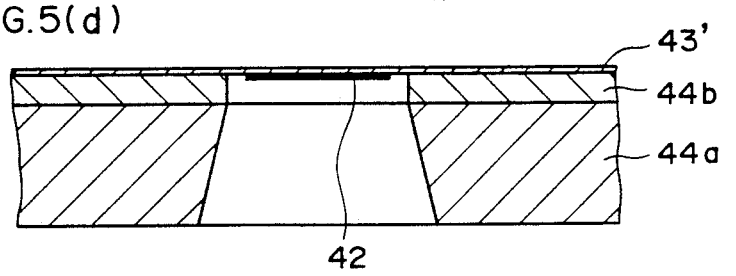

As shown in FIGS. 3 and 4, the photocathode screen 42 disposed on the boundary between the first vacuum compartment 31 and the second vacuum compartment 41 is evaporated on the side of a support film 43 opposite to the second vacuum compartment 41. The support film 43 is formed so as to close an aperture at the center of a support plate 44. Two openings or holes 40 are formed in the support plate 44, and enable communication between the first and the second vacuum compartments 31,41. In an electron imaging unit 4, two electromagnetic coils 47,48 are wound on the exterior of the vacuum chamber 100 which magnifies the electron image. An MCP 45 is provided in the second vacuum compartment 41 on the side opposite to the photocathode screen 42. A phosphor screen (display screen) 46 made of, for example, ZnS(Ag) is formed by deposition on the inside wall of the vacuum chamber 100 behind MCP 45.

As shown in FIG. 3, X-rays penetrate the support film 43 to reach the photocathode screen 42, and, in response to the incident X-ray, photo-electrons are emitted by the photocathode screen 42 to the side of the second vacuum compartment 41. The support film 43 has to be made of an X-ray penetrative material, for example, an organic material such as poly-para-xylylene, poly-propylene, etc, or silicon nitride ($Si_3N_4$) which does not include carbon. The support film 43 has to be thin enough not to hinder the penetration of soft X-rays therethrough and preferably has a thickness of less than about three microns(μm). Specifically, in the case of a penetration of above 20% through the support film 43 for a wavelength of 30–40 Å, the support film 43 has a thickness of below 0.5 μm for poly-para-xylylene and below 0.25 μm for silicon nitride. It is possible to increase the thickness of the support film 43 when the X-ray incident on the support film 43 has higher intensity, or where a highly penetrative X-ray having a short wavelength (for example, less than about 10 Å) is used. In this embodiment, since the holes 40 in the support plate 44 provide communication with the first vacuum compartment 31 and the second vacuum compartment 41, the degree of difference of the vacuum between the first and the second vacuum compartments 31,41 can be substantially compensated. Consequently, even though the support film 43 is made sufficiently thinner, it never breaks due to a pressure difference. The photocathode screen 42 is made of gold (Au) film, which is able to convert X-ray photons directly into electrons but may be made of a two layer film comprising a cesium iodide and antimony cesium.

When an electrons are focussed on the front surface of MCP 45 by the electron imaging unit 4, the incident electrons are multiplied by MCP 45 and impact onto the phosphor screen 46. Consequently, a light image corresponding to the electron beam on MCP 45 is produced on the phosphor screen 46. In the case that the magnification of the glazing incidence mirror 32 is 20 times, the resolving power of the photocathode screen 42 is 1 μm, and the magnification of an electron lens comprising electromagnetic coils 47,48 is 100 times, the resolving power on the specimen 25 is 1 μm/20=50 nano meters (nm), and on the phosphor screen 46 light image of 0.1 mm can be obtained for 50 nm on the specimen 25.

A light image produced on the phosphor screen 46 is caught by a TV camera 52 through a relay lens 51, and the magnified light image caught by the TV camera 52 is converted into an electrical video signal, and the signal is sent to a video frame memory 53. The video frame memory 53 converts the analog electric video signal to a digital signal and integrates the digital video signals for a certain period of time. The integration result is supplied to a monitor 54. The monitor 54 produces a visible image on the screen, based on the integration result. The TV camera 52 takes a picture of the visible image produced on the phosphor screen 46, so that the specimen can be visualized at the resolving power of 50 nm thereon easily on the monitor 54. That is, in the case that the magnification of the relay lens 51 is once, and the size of the input surface of the TV camera 52 is 10 mm×10 mm, and the screen of the monitor is 20 cm×20 cm, the X-ray microscope itself provides a magnification of 20×100×20=40000. The integration of signals by the video frame memory 53 is effective especially when the X-ray absorption image is faint. In this case the magnified image cannot be observed real time, but can be observed continuously. In contrast, in the case that the X-ray absorption image has a sufficient intensity, the video frame memory 53 does not have to be used. In this case, the resolution power of the TV camera 52 in terms of time allows one sheet of picture to be taken every 1/30 seconds. A substantially real time X-ray shadow image can be observed.

Next, the methods of making the photocathode screen and the support film will be explained with reference to FIG. 5.

As described above, the support film 43 for supporting the photocathode screen 42 has to be made thin enough so as not to hinder the penetration of the X-ray. First, as shown in FIG. 5(*a*), a polycrystal silicon (Si) 44*b* is formed on a silicon substrate 44*a* by, for example, the epitaxial growth. Further, a thermally oxidized layer 43′ of $SiO_2$ is formed thereon by thermal oxidation. Instead of the thermally oxidized layer, a silicon nitride ($Si_3N_4$) layer may be formed thereon. Since the uppermost layer 43′ functions as the support film 43 of the photocathode screen 42, it is made very thin, such as, for example less than about three hundred Angstroms.

As shown in FIG. 5(*b*), a photoresist is subsequently applied to the underside of the silicon substrate 44*a*, and the photoresist is partially exposed and then developed to form a mask 71. Then the silicon substrate 44*a* is selectively wet etched into the structure shown in FIG. 5(*b*). Next, without removing the mask 71 of the photoresist, the polycrystal Si 44*b* is selectively phase etched into the structure of FIG. 5(*c*) in which the uppermost layer 43′ is left. Layer 43′ has an even thickness and a sufficient intensity. As shown in FIG. 5(*d*), Au(gold) is evaporated at a certain position in a hole formed beforehand from the side of the silicon substrate 44*a* to form the photocathode screen 42. The photocathode screen assembly having the thus formed photocathode screen 42 and the support film 43 is disposed on the boundary between the first and the second vacuum compartments 31,41.

Figure 6:
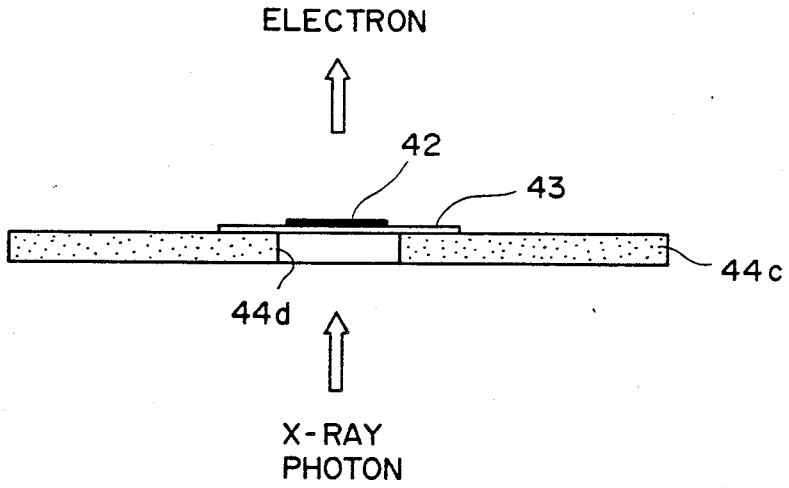
FIG. 6 is a sectional view of another embodiment of the photocathode screen assembly of this invention.

The photocathode screen assembly may be formed as shown in FIG. 6. An aperture 44*d* is formed in a support body 44*c* comprising glass, metal, silicon, etc., and the support film 43, made of, for example, poly-para-xylylene is adhered thereto so as to close the aperture 44*d*. Then the photocathode screen 42 made of, for example, Au(gold) is evaporated on the support film 43.

Another embodiment of the X-ray microscope will be explained, with reference to FIG. 7.

Figure 7:
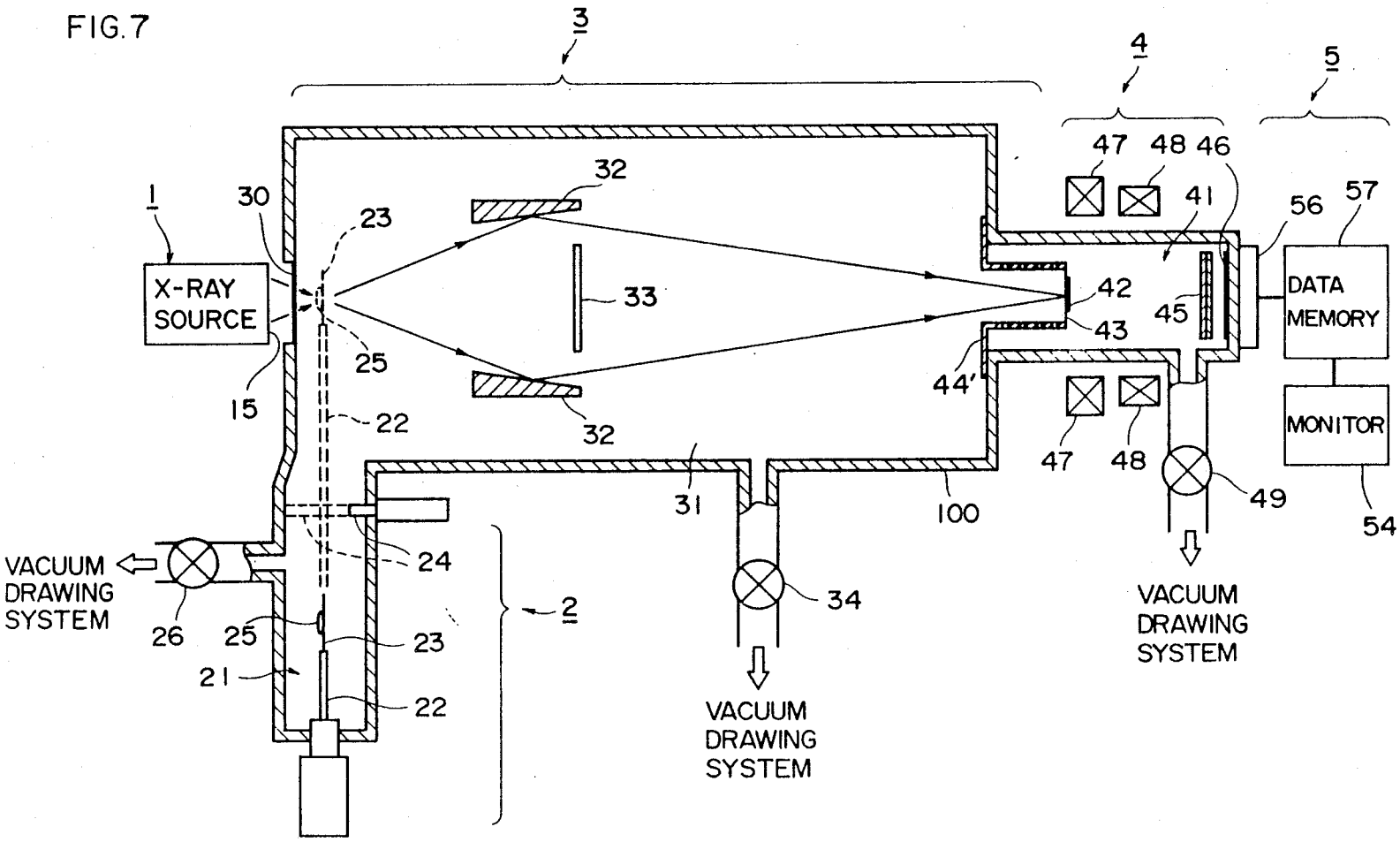
FIG. 7 is a side view of an X-ray microscope incorporating another embodiment of this invention.

As shown in FIG. 7, the specimen mounting unit 2 is disposed in a vacuum chamber 100. That is, specimen compartment 21 is attached on the vacuum chamber 100 at one end. The specimen compartment 21 is in communication with the first vacuum compartment 31 through a gate valve 24 which can be opened or closed. When the specimen 25 is mounted, the gate valve 24 is closed as indicated by the dotted line in FIG. 7 to release the vacuum of the specimen compartment 21. In this condition, the manipulater 22, and the specimen mount 23 are accommodated in the specimen compartment 21 as indicated by the solid line in FIG. 7, and the door (not shown) is opened to set the specimen 25 on the specimen mount 23. Then the door is closed, and a valve 26 is opened to create a vacuum in the specimen compartment 21. When the vacuum of the specimen compartment 21 becomes about $10^{-5}$–$10^{-6}$ Torr, the gate valve 24 is opened, as indicated by the solid line in FIG. 7, so as to operate the manipulater 22 to move the specimen mount 23 to an observation position. Thus the specimen 25 is mounted on a set position in the first vacuum compartment 31. Accordingly the X-ray which has penetrated the specimen 25 is incident on the glazing incidence mirror 32 without being attenuated.

Figure 8:
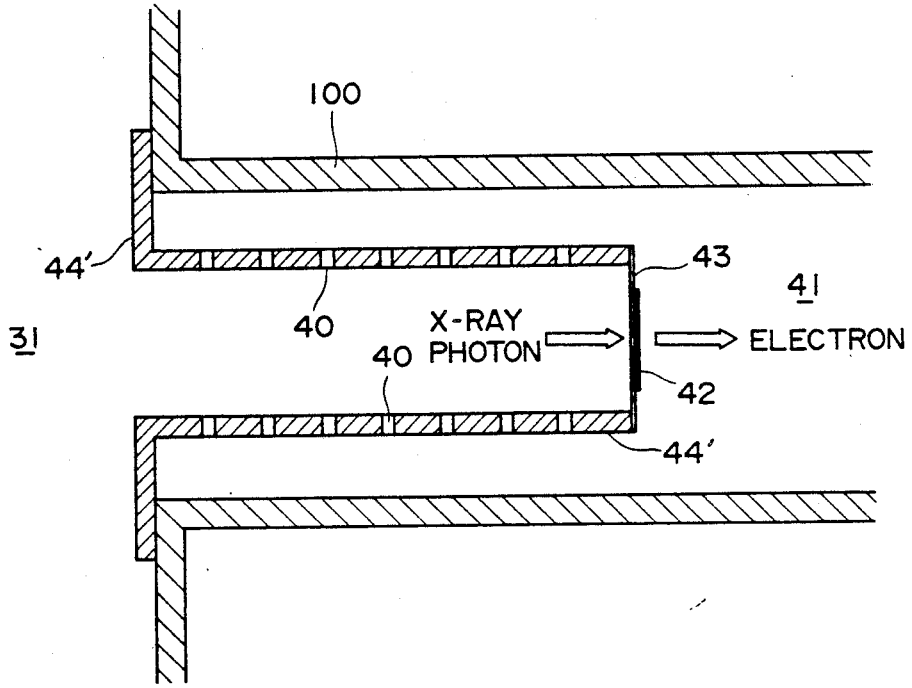
FIG. 8 is an enlarged sectional view of the structure surrounding the photocathode screen.

FIG. 8 shows an enlarged diagrammatic view of the vicinity of the photocathode screen 42 in FIG. 7. As shown in FIG. 8, the first vacuum compartment 31 and the second vacuum compartment 41 are partitioned by a support member 44', and the support member 44' is secured at the proximal end to the inside surface of the vacuum chamber 100. The support member 44' is in the form of a cylinder projected into the side of the electron imaging unit 4, and the support film 43 is fixed to the forward end thereof. The support film 43 is evaporated on the end of the photocathode screen 42. The support film 43 is thin enough for the X-ray to penetrate (less than about three μm) and is made of an X-ray penetrative material. As shown in FIG. 8. when an X-ray is incident on the support film 43, photoelectrons are emitted to the opposite side. The cylinder of the support member 44' accommodates a number of through holes 40 in the side wall of the support member 44'. Accordingly the through holes 40 permit a larger amount of a gas to flow in the first and the second vacuum compartments 31,41, compared with the above described embodiment. Consequently, even when the degree of the vacuum in the second vacuum compartment 41 decreases due to insufficient release of the gas of the phosphor screen 46, or even when there is a difference between evacuation capability through the valve 34 and that through the valve 41, the difference in the pressure between the first and the second vacuum compartments 31, 41 is promptly compensated. Accordingly this enables the support film 43 to be made as thin as possible with a result that the attenuation of the X-ray can be sufficiently lowered.

As shown in FIG. 7, a solid-state image sensor 56 is fixed to the outside surface of the vacuum chamber 100 at the position opposite the phosphor screen 46. The solid-state image sensor 56 consists of, for example, a charge coupled device (CCD) and has a scanning circuit built in. The output data of the solid-state image sensor 56 is temporarily stored by a data memory 53' having the same function as the video frame memory 53 and is then supplied to the monitor 54 to be displayed on the screen. In the case where the solid-state image sensor 56 is fixed to the inside surface of the vacuum chamber 100 in place of the phosphor screen 46 in FIG. 7, the electron image can be directly pictured without converting the electron image into a light image on the phosphor screen 46.

Figure 9:
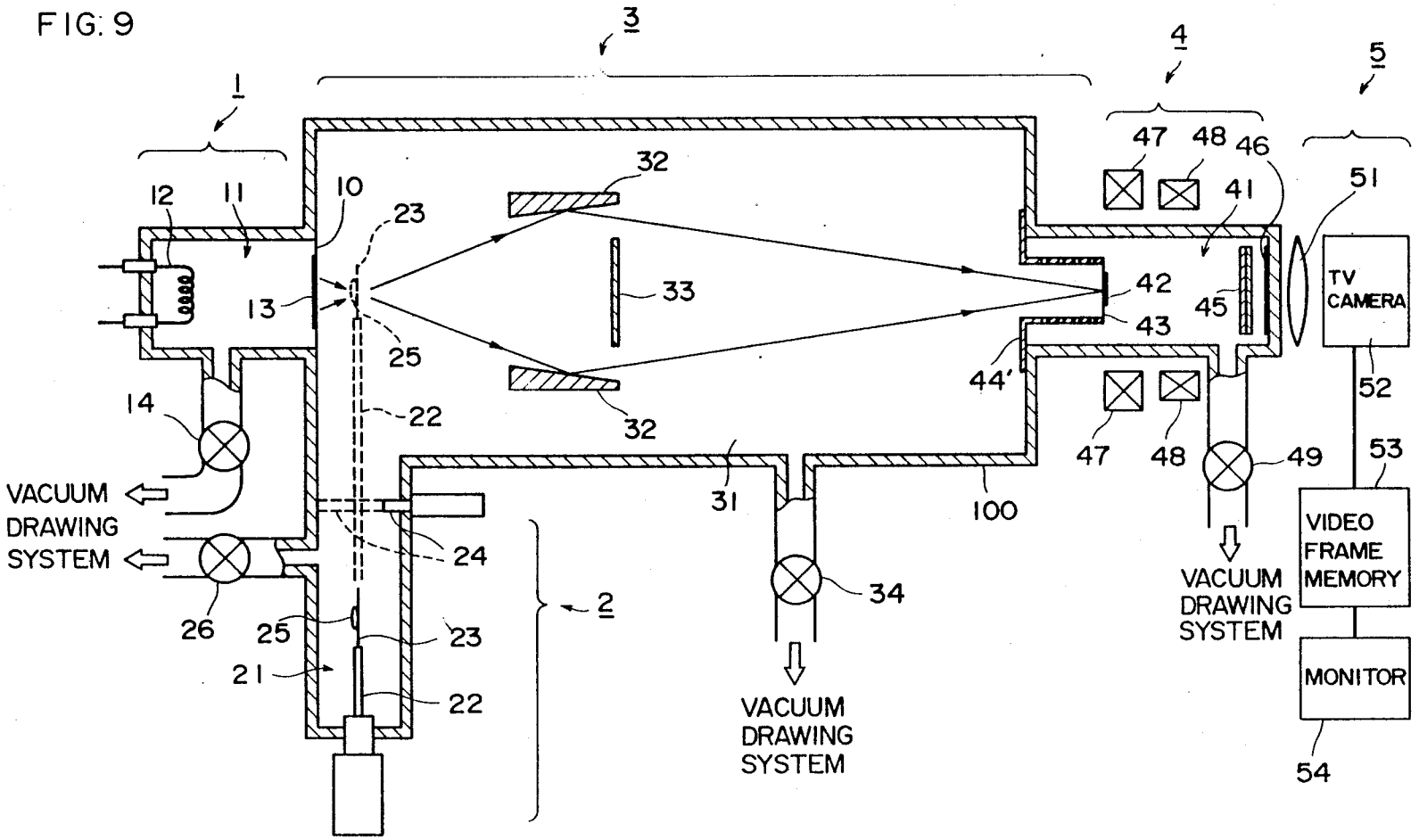
FIG. 9 is a side view of an X-ray microscope incorporating an embodiment of this invention.

The device according to the second embodiment of this invention differs from that of the first embodiment of this invention in that the X-ray source 1 is incorporated in the vacuum chamber 100. The device according to the second embodiment of this invention will be explained in more detail with reference to FIG. 9. The X-ray source 1 is disposed in a third vacuum compartment 11 defined in the vacuum chamber 100 by a partitioning film 10 and comprises a hot cathode 12 for emitting thermoelectrons, and a target 13 fixedly formed on the partitioning film 10 so as to radiate the X-ray to the first vacuum compartment 31 in response to incident electrons thereto. The third vacuum compartment 11 is in communication with the vacuum draw unit through a valve 14. The partitioning film 10 is made of an X-ray penetrative material (for example, poly-para-xylylene, silicon nitride, etc) and is made thin enough so as not to attenuate very much the X-ray radiated into the first vacuum compartment 31. In this embodiment, unlike the first embodiment of this invention, since the X-ray source 1 is disposed within the vacuum chamber 100, no atmospheric pressure is applied to the partitioning film 10. It is thus possible to make the partitioning film 10 as thin as possible. The provision of vent holes across the first and the third vacuum compartments 31,11 enables the partitioning film 10 to be made thinner without being broken by the difference in degree of the vacuum. The target 13 may be made of, for example, carbon or other similarly acting material. Since in the embodiment of FIG. 9, the specimen mounting unit 2, the X-ray imaging unit 3 and the electron imaging unit 4 have the same structures as in the embodiment of FIG. 7, and the light imaging unit 5 has the same structure as in the embodiment of FIG. 1, a detail explanation of each is omitted.

Figure 10:
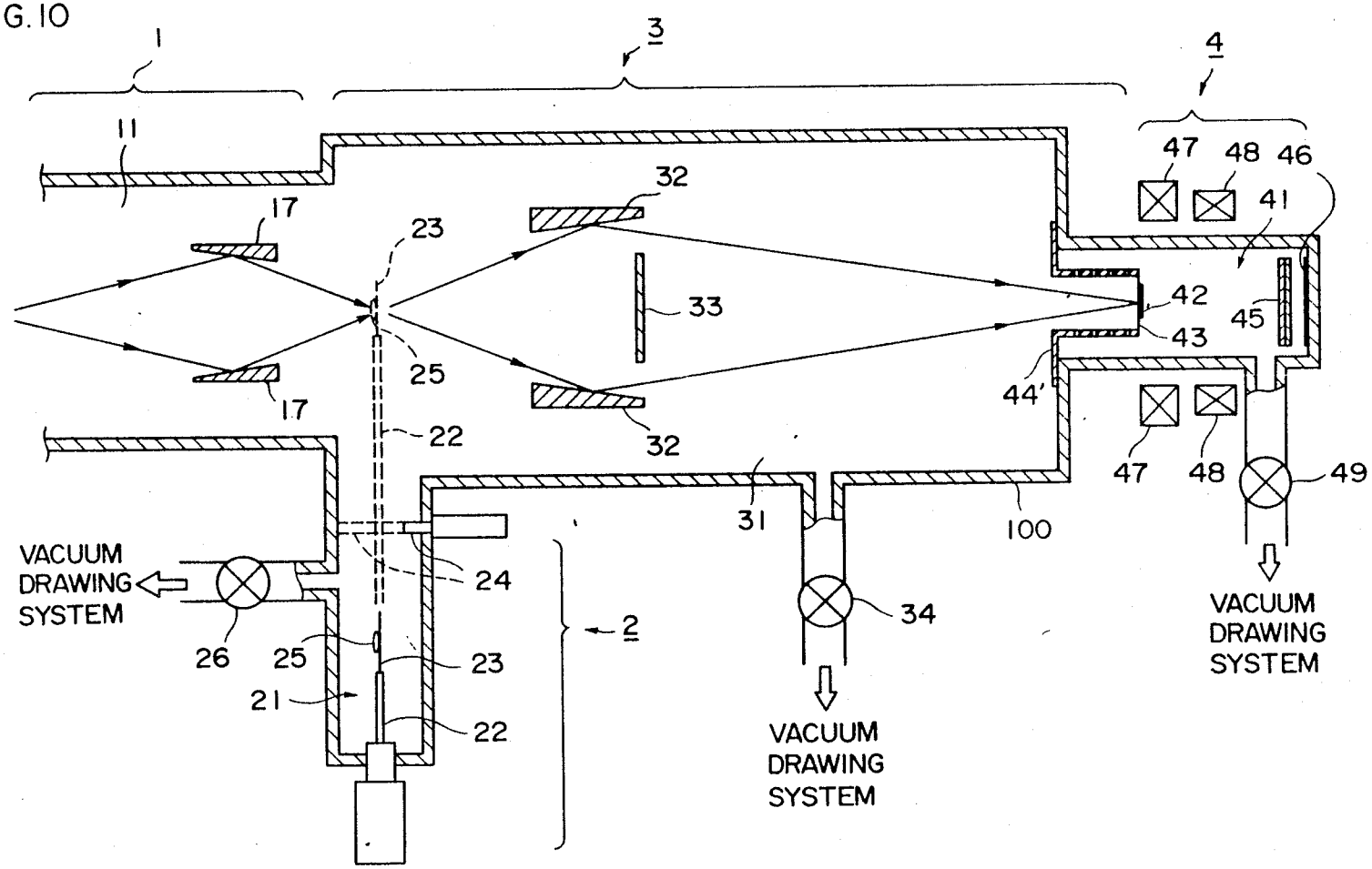
FIG. 10 is a side view of an X-ray microscope incorporating one modification of the embodiment of FIG. 9.

FIG. 10 shows a modification of the device according to the second embodiment of this invention. In the modification of FIG. 10, no partitioning film is provided between the first and the third vacuum compartments 31,11. The third vacuum compartment 11 provides a synchrotron radiation source (SOR source). A reflecting mirror 17 is provided to converge an X-ray from SOR source onto the specimen 25. In this modification, since the first vacuum compartment 31 is connected to the SOR source, the vacuum degree of the vacuum chamber 100 has to be about $10^{-8}$ Torr. In the other portions this modification is the same as the embodiment of FIG. 9.

The X-ray image observing device is not limited to the above described embodiments and includes its modifications and variations without departing from the scope of the claims.

To give examples, in the embodiment of FIG. 1, the X-ray source 1 is not limited to the one which radiates only the X-ray but may be, e.g. a laser plasma source which simultaneously radiates an X-ray and an ultra violet ray. In this case a filter of, for example, poly-para-xylylene, suitable for shutting off the ultra violet rays is provided on the input window 30, so that only the X-rays are permitted to be incident in the first vacuum compartment 31. A gas plasma source may be used, but since the source, in operation, generates gases, a partitioning film is necessary, different from the structure of FIG. 10. The means for magnifying the X-ray absorption image is not limited to the glazing incidence mirror 32 but may be, for example, an X-ray zone plate or a multi layer screen X-ray reflecting mirror. In the case that the radiated X-ray has high intensity, MCP 45 is not required in the electron imaging unit 4.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

We claim:

1. An X-ray image observing device comprising:

a vacuum chamber;

X-ray imaging means disposed in said vacuum chamber for magnifying an X-ray image to form a magnified X-ray image at a first position of said vacuum chamber;

X-ray converting means disposed at said first position for converting incident X-rays into electrons and emitting the converted electrons from a side opposed to the X-ray incident side thereof; and electron image formation means for guiding the electrons emitted from said X-ray converting means to a second position of said vacuum chamber to form an electron image corresponding to said magnified X-ray image at said second position of said vacuum chamber.

2. An X-ray image observing device according to claim 1, wherein said electron image formed by said electron image formation means is magnified with respect to said magnified X-ray image.

3. An X-ray image observing device according to claim 1, further comprising:

an X-ray source located outside of said vacuum chamber and said X-ray source having a radiation surface;

an object mounting means disposed between said radiation surface of said X-ray source and said vacuum chamber for positioning an object to be observed, and wherein X-rays radiated from said X-ray source is projected from said X-ray source to said object and directed into said vacuum chamber through an input window provided on said vacuum chamber.

4. An X-ray image observing device according to claim 3, wherein, on a side of said vacuum chamber nearest to said input window, there is provided an object compartment which is in communication with said vacuum chamber through an openable and closable gate valve, said vacuum chamber being adapted to draw a vacuum, said object mounting means being positioned in said object compartment, and said X-ray image observing device further including opening means for opening said gate valve and said object mounting means including positioning means for positioning said object adjacent said input window.

5. An X-ray image observing device according to claim 1, wherein said X-ray converting means comprises a support film having an X-ray incident side and an opposite side, said X-ray converting means further comprising a photocathode screen formed on the opposite side of said support film, and said support film being held by a support member fixed to said vacuum chamber.

6. An X-ray image observing device according to claim 5, wherein said support film is made of an X-ray penetrating material and has a thickness which essentially does not hinder the penetration of X-rays.

7. An X-ray image observing device according to claim 5, wherein said support member has at least one through hole.

8. An X-ray image observing device according to claim 7, wherein said support member is a cylindrical body projecting in an electron emitting direction and said support film is provided at said first position.

9. An X-ray image observing device according to claim 1, wherein at said second position there is provided a display screen which scintillates in response to an incident electron, and said display screen is formed on a light transmitting inside surface of said vacuum chamber.

10. An X-ray image observing device according to claim 9, wherein a microchannel plate for multiplying an electron incident thereinto is arranged between said display screen and said X-ray converting means.

11. An X-ray image observing device according to claim 1, further comprising imaging means for taking a picture of said electron image formed by said electron image formation means.

12. An X-ray image observing device according to claim 11, wherein said imaging means comprises electron conversion means for converting said electron image into a light image, and optical imaging means for taking a picture of said light image.

13. An X-ray image observing device according to claim 11, wherein said imaging means has storing means for storing the data obtained from said picture for a certain period of time.

14. An X-ray image observing device comprising:

a vacuum chamber;

an X-ray source disposed in said vacuum chamber;

X-ray imaging means disposed in said vacuum chamber for magnifying an X-ray image formed by the radiation of said X-ray source to form a magnified X-ray image at a first position of said vacuum chamber;

X-ray converting means disposed at said first position for converting incident X-rays into electrons and emitting the converted electrons from a side opposed to the X-ray incident side thereof; and electron image formation means for guiding the electrons emitted from said X-ray converting means to a second position of said vacuum chamber to form an electron image corresponding to said magnified X-ray image at said second position of said vacuum chamber.

15. An X-ray image observing device according to claim 14, wherein said electron image formed by said electron image formation means is magnified with respect to said magnified X-ray image.

16. An X-ray image observing device according to claim 14, wherein said X-ray source comprises a cathode for emitting electrons, and said X-ray source further comprises a partitioning film and an X-ray target formed on said partitioning film, said X-ray target emitting said X-rays in response to incident electrons originating from said cathode.

17. An X-ray image observing device according to claim 16, wherein on the side of said vacuum chamber nearest said X-ray target there is provided an object compartment which is in communication with said vacuum chamber through an openable and closable gate valve and said vacuum chamber being adapted to draw a vacuum; object mounting means for setting an object to be observed is provided in said object compartment, said image observing means further including opening means for opening said gate valve and said object mounting means including positioning means for positioning said object adjacent said X-ray target.

18. An X-ray image observing device according to claim 14, wherein said X-ray converting means comprises a support film having an X-ray incident side and an opposite side, said X-ray converting means further comprising a photocathode screen formed on the opposite side of said support film, and said support film being held by a support member fixed to said vacuum chamber.

19. An X-ray image observing device according to claim 18, wherein said support film is made of an X-ray penetrating material and has a thickness which essentially does not hinder the penetration of the X-rays.

20. An X-ray image observing device according to claim 19, wherein said support member has at least one through hole.

21. An X-ray image observing device according to claim 18, wherein said support member is a cylindrical body projecting in an electron emitting direction and said support film is provided at said first position.

22. An X-ray image observing device according to claim 14, wherein at said second position there is provided a display screen which scintillates in response to an incident electron, and said display screen is formed on a light transmitting inside surface of said vacuum chamber.

23. An X-ray image observing device according to claim 22, wherein a microchannel plate for multiplying an electron incident thereinto is arranged between said display screen and said X-ray converting means.

24. An X-ray image observing device according to claim 14, further comprising imaging means for taking a picture of said electron image formed by said electron image formation means.

25. An X-ray image observing device according to claim 14, wherein said imaging means comprises electron conversion means for converting said electron image into a light image, and optical imaging means for taking a picture of said light image.

26. An X-ray image observing device according to claim 24, wherein said imaging means has storing means for storing the data obtained from said picture for a certain period of time.

27. An X-ray image observing device according to claim 24, wherein said imaging means has storing means for storing the data obtained from said picture for a certain period of time.

* * * * *